United States Patent [19]

Rohner

[11] Patent Number: 4,669,259

[45] Date of Patent: Jun. 2, 1987

[54] SPINNING MACHINE

[75] Inventor: Joachim Rohner, Ebersbach, Fed. Rep. of Germany

[73] Assignee: Zinser Textilmaschinen GmbH, Ebersbach, Fed. Rep. of Germany

[21] Appl. No.: 858,935

[22] Filed: Apr. 30, 1986

[30] Foreign Application Priority Data

May 2, 1985 [DE] Fed. Rep. of Germany ..... 3515677

[51] Int. Cl.[4] ..... D01H 11/00; D01H 13/16; D01H 5/66

[52] U.S. Cl. ..... 57/305; 19/263; 57/80; 57/81; 57/304

[58] Field of Search ..... 57/304, 305, 80, 81, 57/87, 78; 19/262, 263

[56] References Cited

U.S. PATENT DOCUMENTS

| | | | |
|---|---|---|---|
| 2,522,250 | 9/1950 | Bechtler | 19/263 X |
| 2,819,579 | 1/1958 | Avera | 57/305 |
| 2,849,852 | 9/1958 | Jacobi et al. | 19/263 |
| 4,375,149 | 3/1983 | Hartmannsgruber | 57/304 X |
| 4,519,199 | 5/1985 | Barauke | 57/305 X |
| 4,590,646 | 5/1986 | Gasser | 19/263 X |

*Primary Examiner*—John Petrakes
*Attorney, Agent, or Firm*—Karl F. Ross; Herbert Dubno

[57] ABSTRACT

The spinning machine comprises a drafting frame for drawing sliver and at least one fiber suction station connected to a vacuum source associated with this drafting frame. To save energy each fiber suction station is provided with a sensing means for detection of broken fiber or roving and throttling means for throttling the suction. The throttling means is adjustable to a throttled position in the air stream which considerably reduces the air flowing into the fiber suction duct. This throttling means is also automatically disengagable into a position resulting in a considerably increased air flow rate following detection of broken fiber or roving by the sensing means.

9 Claims, 7 Drawing Figures

SPINNING MACHINE

CROSS REFERENCE TO RELATED APPLICATIONS

This application is related to commonly assigned and copending application Ser. Nos. 858,937 and 861,533 respectively filed Apr 30 and May 09 1985.

FIELD OF THE INVENTION

My present invention relates to a spinning machine having a drafting frame for drafting sliver or roving into roving or yarn respectively, for instance a ring spinning machine, fly frame, or similar machine for manufacturing yarn or roving from sliver or roving, respectively. More particularly this invention relates to an improved mechanism for removing broken yarn or roving from such a spinning machine.

BACKGROUND OF THE INVENTION

A spinning machine used to manufacture yarn or roving from roving or sliver can comprise a drafting frame for drawing sliver or roving and at least one fiber suction station connected to a vacuum source associated with each working position of the drafting frame. In operation the yarn or roving running from the feed rollers of the drafting frame is under continuous suction, so that both fuzz from the edges of the yarn or fed from the drafting frame and broken yarn and roving can be removed from the working positions of the drafting frame.

My invention involves a spinning machine which has a drafting frame from whose feed rollers roving fibrous strand is run out and twisted to yarn or roving. The sliver or roving runs through the drafting frame and leaves the pair of supply rollers of the drafting frame untwisted, is in ring spinning from twisted to yarn, or in fly frame with a weaker rotation to roving. So a spinning machine which manufactures yarn or thread from roving or sliver fed from a drafting frame may be called a finish spinning machine. My invention is however also applicable to a flyer frame, particularly with a flyer which produces roving.

These spinning machines also have an associated fiber suction device or mechanism. In a manufacturing spinning machine one characterizes such a fiber suction mechanism or device as a fiber suction device or mechanism which following a yarn or roving breaking draws away fibers from the concerned drafting frame so that they do not get into the air surrounding the spinning machine as fiber fuzz which is a significantly disturbing contaminant. Also removal by suction of fibers or fiber fragments prevents the winding of fragments on the feed rollers of the drafting frame by sliver fragments not spun into yarn.

In the flyer frame which can be used for manufacture of roving, a fiber suction mechanism or device can also often be used which in case of broken roving fed from a wound up position or a supply position in the drafting frame draws away broken roving.

A fiber suction station is a position where fiber strand running from the drafting frame following a yarn or roving break is drawn off. The drawing in of air at the fiber suction station makes one or more vacuum sources such as a ventilator or blower necessary. Since several hundred fiber suction stations can be present in a spinning machine the generation of an air flow by suction causes a comparatively large energy consumption and thus increases energy costs.

To reduce energy costs associated with suction of air at the fiber suction stations, it is known to keep the fiber suction stations normally closed by a valve or shut off means and to open a fiber suction station for sucking in fibers, only when a broken yarn or roving occurs at the working position associated with this fiber suction station (U.S. Pat. No. 2,819,579).

Thus of course energy that would be used to produce suction is saved, but there is a disadvantage, namely that the fiber suction stations can pull away fibers or the like only in case of broken yarn or roving.

Of course it is highly advantageous to provide suction continuously at all the fiber suction stations during operation of the spinning machine.

Even when the yarn or roving does not break, fuzz continually occurs which is not bound to the yarn or the roving but, if it is not removed, hangs free in the air surrounding the spinning machine and eventually deposits and accumulates. This fuzz can lead to extensive contamination of the machine. Thus the suction action at the various fiber suction stations provides much needed ventilation of the spinning machine room.

OBJECTS OF THE INVENTION

It is an object of my invention to provide an improved spinning machine which obviates disadvantages of earlier machines.

It is also an object of my invention to provide an improved spinning machine in which an increased saving of energy required to provide suction to the fiber suction stations in the spinning machine is attained while simultaneously a degreee of suction is on continuously at all the fiber suction stations.

SUMMARY OF THE INVENTION

These objects and others which will become more apparent hereinafter are attained in a spinning machine used to manufacture yarn or roving from roving or sliver comprising a drafting frame for drawing sliver or roving and at least one fiber suction station connected to a vacuum source associated with each working position of the drafting frame. In operation the fibre strand running from the feed rollers of the drafting frame is under continuous suction, so that both fuzz from the edges of the roving fed from the drafting frame and broken yarn and roving can be removed from the working positions of the drafting frame.

According to my invention at each of a plurality of fiber suction stations a sensing means to detect when a yarn or roving breaks is provided at each working station of the spinning machine and every one of the fiber suction stations has a throttling means for throttling the volume flow rate of air pulled in.

The throttling means at each intake port normally is adjustable or shiftable to a throttled position corresponding to a considerably reduced air flow and to a position with comparatively larger air volume flow rate by automatic activation by the sensing means following detection of broken fiber or roving.

In my invention suction is continuously on at all fiber suction stations during operation of the spinning machine and yet an increased saving of energy used to provide that suction has been attained.

Surprisingly one can manage to provide suction for removal of contaminant fuzz and for continuous ventilation of the machine room air as well as for removal of large quantities of fibers occurring at the working positions of the machine following a yarn or roving breaking event.

My invention thus combines the advantage of increased energy saving with the advantages of continuous suction at these fiber suction stations. The individual fiber suction stations can be formed by suction tubes connected to a horizontal suction duct or also by a hole in a wall of the suction duct or in some other way. How strongly the individual suction stations should be throttled by the throttling means depends on a variety of factors and can be easily determined experimentally.

The throttling means can be a throttling plate or a throttling valve.

The fiber suction stations can comprise a suction tube connected to a horizontal suction duct and throttlable by the throttling means. Each throttling means is advantageously associated with a suction outlet of a fiber suction station. Also the throttling means may act by decreasing the open cross sectional area of the suction tube.

In another embodiment of my invention the suction tube has an elastic wall portion which is deformable by an adjusting means to reduce the cross sectional area of the suction tube.

Furthermore a throttling plate can be mounted in the suction duct sitting at one particular cross sectional position in a further embodiment.

In one embodiment of my invention the sensing means has a mechanical sensor for yarn- or roving-breakage contacting on a section of the yarn or the roving which changes position following formation of broken yarn or roving. The mechanical sensor acts together directly with the throttling means to adjust the volume flow rate of the air.

The sensing means can also have a sensor which, when it detects the breaking of a yarn or roving, activates one of the throttling means associated with one of the working positions by an adjusting device, such as a servomotor or other adjusting motor, e.g. an electromagnet, following the detection of a yarn- or roving-breakage.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
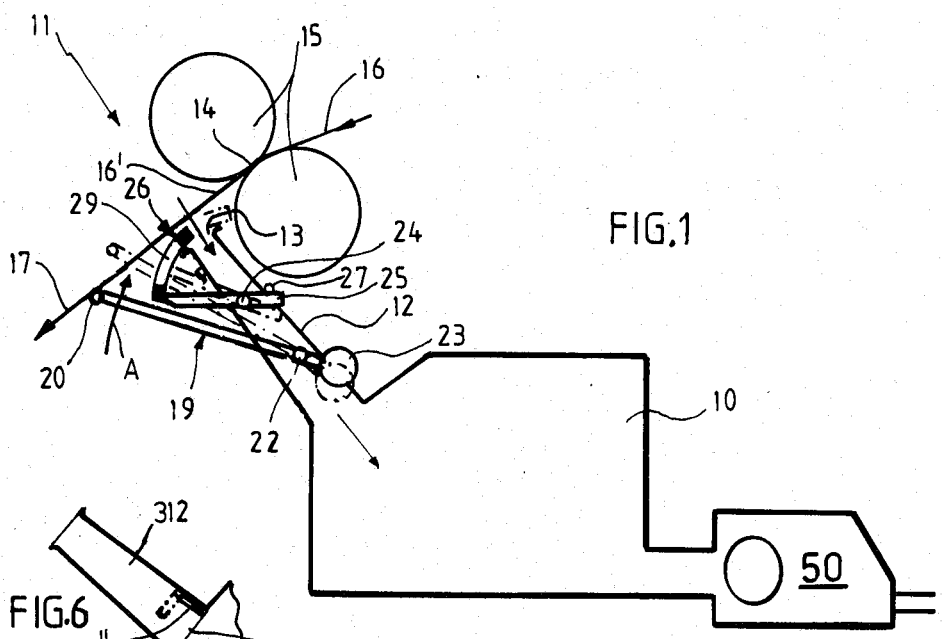
FIG. 1 is a schematic side cross sectional view of a fiber suction station of a spinning machine according to my invention wherein only one pair of feed rollers from the drafting frame are shown and details of the spinning machine which are not necessary for an understanding of the invention, are not shown.

In FIG. 1 a suction duct 10 with a comparatively large cross section is shown. It extends along all the working positions (spinning positions) of one longitudinal side of the spinning machine. A suction source 50 such as a suction blower or ventilator is connected to the suction duct 10. In cases where the machine has working positions along both longitudinal sides the other longitudinal side can also be provided with a suitable not illustrated suction duct.

A suction tube 12 connected to the suction duct 10 at each working position on the concerned longitudinal side of the machine forms a fiber suction station. The suction outlet 13 of the suction tube 12 is positioned at a small spacing from the clamping gap 14 of a pair of feed rollers 15 of a drafting frame 2. These feed rollers 15 are the outgoing side roller pair of a drafting frame 2 which draws roving 16. The remaining drafting frame rollers are sketched in FIG. 7.

Figure 7:
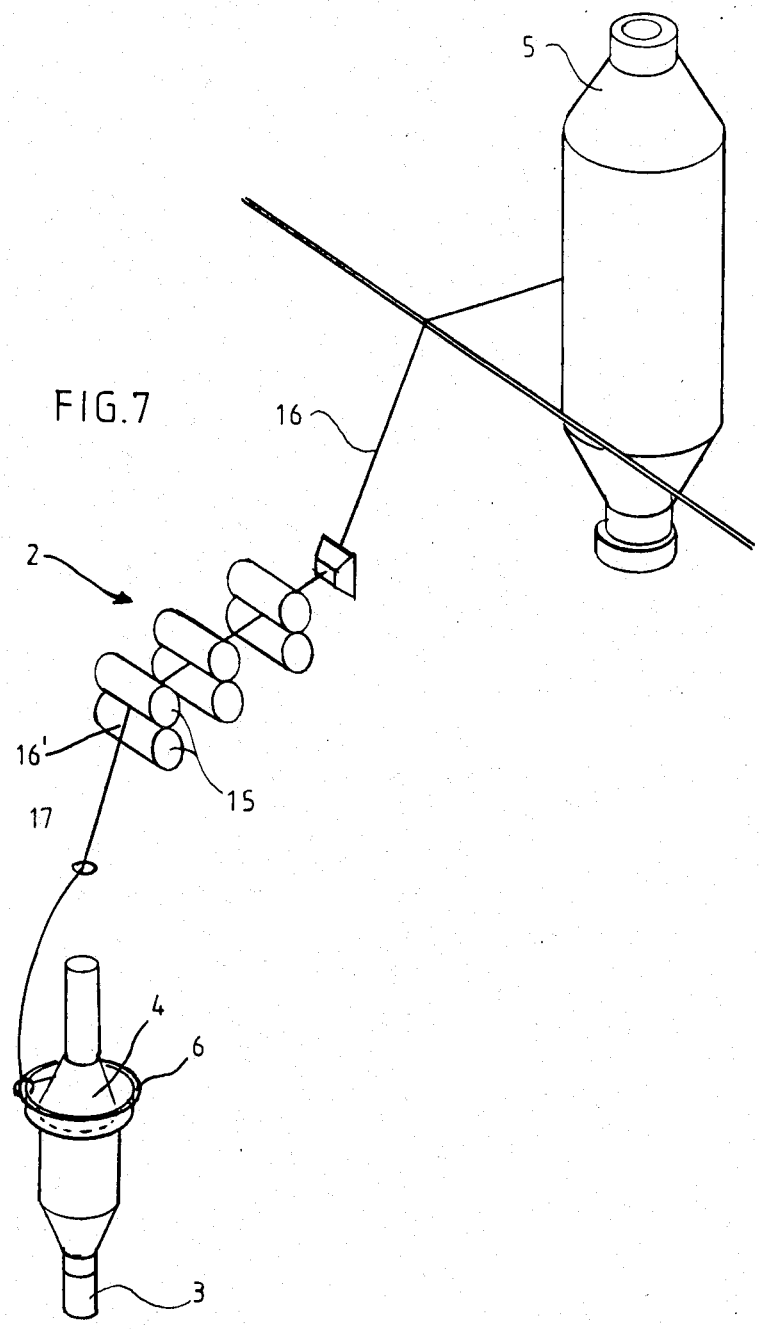
FIG. 7 is a diagram of a ring spinning machine.

The spinning machine as mentioned earlier can be a ring spinning machine as shown in FIG. 7, a bell spinning machine or some other type of spinning machine having drafting rollers. It can also be a flyer frame or flyer having a drafting frame 2 for drawing sliver. In a flyer frame the sliver running from the drafting rollers 2 (FIG. 7) is twisted to roving 17.

In the following for simplification the examples describe a fiber suction duct 10 in a spinning machine used for yarn manufacture which makes yarn 17 at each of its work stations by rotation of roving 16' running from the pair of feed rollers 15. The drawing thus shows a cross section at a work station of the spinning machine.

The outlet 13 of the suction tube 12 is spaced a short distance below the path of the roving 16' as it comes from the feed rollers 15. This fiber suction station has a sensing means or sensor 19 for yarn breakages associated with it which comprises a two-arm lever pivotable about a pivot axis 22 perpendicular to the plane of the drawing.

The upper end 20 of the yarn sensing means 19 is bent and contacts one section of the underside of the yarn 17 running to the location where it is wound up on a spindle 3, spinning top or the like from the pair of feed rollers 15.

A weight 23 is attached to the other end or the shorter lever arm of the fiber sensing means 19. This weight 23 creates a torque which tends to rotate this lever continually in the direction indicated by the arrow A.

As long as the yarn 17 is present and continuous it keeps the lever 19 in the position shown, in which it is found spaced from the left end of a part-cylindrical throttle valve 26 pivotally mounted with a rod member 25 supported pivotable about a pivot axis 24 perpendicular to the plane of the drawing.

The throttling valve 26 acts as a throttling means for the flow of air. It is kept in this position by the rotational moment of its own weight about the pivot axis 24 as a result of which the shorter lever arm of the rod member 25 contacts on a fixed stop piece 27 mounted on the body of the suction tube 12. In this normal position of the throttling valve 26 it throttles the suction outlet 13 of the suction tube 12, that is it partially covers that outlet 13 and thus provides only a comparatively small opening in the suction tube 12.

As long as the yarn 17 is present the sensing means or sensor 19 is out of engagement with throttling valve 26.

As soon as the yarn 17 is broken however the broken fiber sensor 19 no longer is held spaced from the throttling valve 26 in the position shown by the yarn 17, but is now moved in the direction of the arrow A into the position shown by the dot-dashed lines by the rotational moment due to the weight 23. During this motion it comes into contact with the left end of the throttling valve 26 and swings it until it is in the position indicated also by dot-dashed lines, in which a larger opening 29 in the throttling valve 26 is aligned with the suction outlet 13 of the suction duct 10 and completely unblocks this suction outlet 13.

Now this suction outlet 13 is no longer throttled and the vacuum present in the suction duct 10 causes a considerably larger volume flow of air into unthrottled suction outlet 13.

When the spinning process starts again after a yarn break in the yarn 17 the yarn sensing means 19 is again brought into the position shown in the drawing with solid lines and the throttling valve 26 is tilted by its own weight again into the position shown in solid lines. Again then the suction outlet 13 of the suction duct 10 is suitably throttled.

The dot-dash maximum open position of the throttling valve 26 is limited in that a lower bent left end of the throttled valve 26 collides with the left side edge of the suction outlet 13 of the suction tube 10.

Since the suction outlets 13 of all the suction tubes 12 of this spinning machine 10 are normally throttled by the throttling valve 26 the flow of air in them is considerably reduced by the throttling. Thus the suction duct 10 can have a considerably smaller cross section than if the suction tubes 12 were unthrottled to continuously pull in air. Also the vacuum source can be considerably weaker and requires considerably less energy for its operation than when the volume flow rate of air pulled through all the fiber suction stations is continuously unthrottled. The mechanical sensing means 19 can also contain a variety of structural components; for example it can be spring loaded or it can have a coil spring under tension.

In many cases it is desired that the throttling valve 26 not be in its maximum open position after a yarn breaking event, but instead in a position in which the suction outlet is still somewhat throttled although considerably less than when the yarn 17 is present.

This can be brought about for example by mounting a limit stop on the suction tube 12, which reduces the pivot angle of the throttling valve 26 operated by the lever 19 somewhat, so that the opening 29 of the throttling valve 26 of the suction outlet 13 is not completely open.

Figure 2:
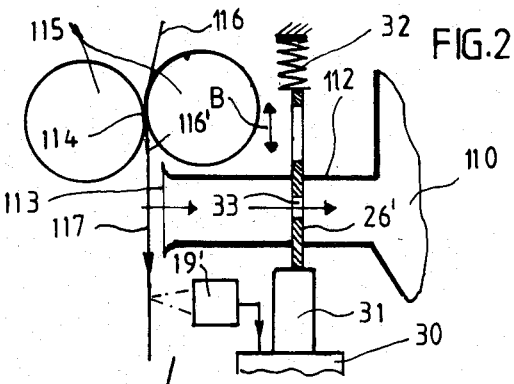
FIG. 2 is a schematic side cross sectional view through a fiber suction station in a second embodiment of a spinning machine according to my invention in which the drafting frame is indicated by only one pair of feed rollers.
Figure 3:
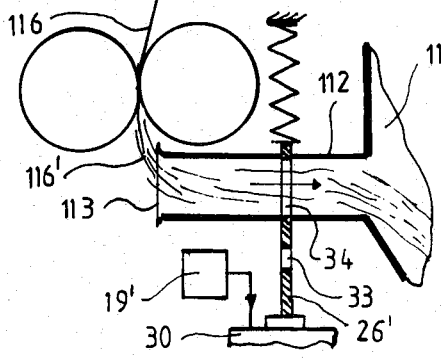
FIG. 3 is a schematic side cross sectional view of the apparatus of FIG. 2 showing the throttling plate in its open position corresponding to a maximum suction rate.

In the embodiment of FIGS. 2 and 3 a suction tube 112 is shown which is connected to a horizontal suction duct 110.

Suction tubes 112 are positioned at all the working positions along the longitudinal side of the concerned spinning machine. Every suction tube 112 is found spaced from the clamping gap 114 of the feed rollers 115 of a drafting frame such as drafting frame 2 shown in FIG. 7. The roving 116′ drawn from the pair of feed rollers 115 at the illustrated working position is twisted to form yarn 117, which runs past the suction outlet 113 of the suction tube 112 spaced a small distance from it.

A noncontacting broken thread sensor is shown here in FIGS. 2 and 3 and is a reflective light barrier 19′ which can sense the presence of a broken fiber. Instead of the reflex light barrier 19′ also another kind of noncontacting light barrier can be provided, for example one based on detection of electrical capacitance, photooptical detection or a mechanical broken fiber sensor.

In this embodiment the suction tube 112 is penetrated by a throttling means, in this case a throttling plate 26′, which is slidable in the direction shown by the double arrow B by an adjusting means, in this case an electromagnet 30, from the throttled position shown in FIG. 2 to the unthrottled position shown in FIG. 3.

As long as the yarn 117 is present it is sensed by the reflex light barrier 19′ and the electromagnet 30 is deenergized. Its supporting bar 31, which is attached to the throttling plate 26′, is moved then by a restoring spring 32 into the position shown in FIG. 2, in which the throttling plate 26′ covers the cross section of the suction tube 112 with the exception of a small opening 33 in the throttling plate 26′ thus considerably decreasing the cross sectional area. The volume flow of the air pulled into the suction duct 110 is correspondingly reduced.

When a yarn break occurs the reflex light barrier 19′ senses it and activates the electromagnet 30 which then pulls its supporting bar 31 into the position shown in FIG. 3.

The throttling plate 26′ then is moved into the position shown in FIG. 3 in which its larger opening 34 is found completely in the suction tube 112. The size of the opening 34 corresponds approximately to the cross sectional area of the suction tube 112 in the vicinity of the throttling plate 26′. Consequently the suction tube 112 is now practically unthrottled and the volume flow rate of air flowing through the suction tube 112 is considerably increased over the position of the throttling plate according to FIG. 2.

The suction tube 112 then pulls roving at the concerned working positions from the drafting frame, since this roving is no longer being spun to yarn.

When the filament breakage has been corrected and the yarn 117 is consequently present the reflex light barrier 19′ senses this and again deactivates the electromagnet 30, whereby its bar 31 with throttling plate 26′ again is returned to the position shown in FIG. 2 by operation of the restoring spring 32.

Figure 5:
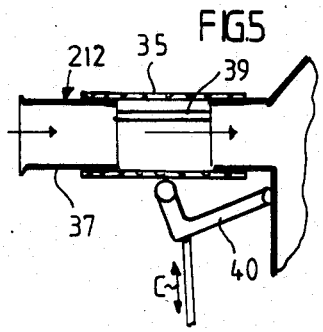
FIG. 5 is a side cross sectional view of the apparatus of FIG. 4 with the fiber suction station in the open unthrottled configuration.
Figure 4:
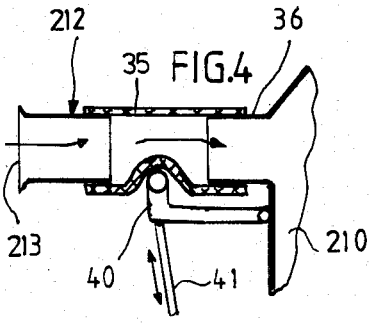
FIG. 4 is a side cross sectional view through another embodiment of a fiber suction station of the spinning machine according to my invention similar to that of FIG. 3 in a throttled configuration with a restricted air flow.

In the embodiment of FIGS. 4 and 5 the throttling of the suction tube 212 is made possible by a lever 40 and by an elastic tubing 35 deformable by the lever 40 and forming a portion of the wall of the suction tube 212. The flexible tubing 35 is pushed on the connector pipe 36 of the suction tube 212 and its other end is connected to the outlet pipe 37 which forms the suction outlet 213. Both the connector pipe 36 and the outlet pipe 37 are connected by at least one rigid bridge member 39 with each other. Tilting of these pipes 36 and 37 with respect to each other is thereby prevented.

A lever 40 is mounted on the suction duct 210, to which an adjusting rod 41 is attached pivotally, which can be moved up and down by a magnet in the direction of the double arrow C. In the position shown in FIG. 4 the lever finds itself in a position pressing strongly inward into the under side of the elastic wall of the tubing 35. Thus the suction tube 212 is then suitably throttled and the volume flow rate is correspondingly reduced.

When a yarn break occurs it is sensed by an unillustrated broken yarn sensor and that activates an adjusting device which causes the lever 40 to move into the position shown in FIG. 5 in which the lever 40 is disengaged from the flexible tubing 35 so that the suction tube 212 now is unthrottled and the volume flow rate of the air pulled in is correspondingly increased.

Figure 6:
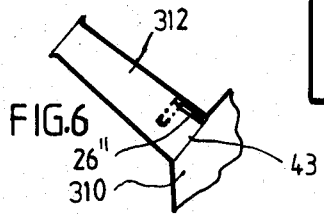
FIG. 6 is a cutaway side cross sectional view of a suction duct from a fiber suction station with an individual suction tube connected and a throttling valve for throttling of the suction tube.

In FIG. 6 a suction tube 312 connected to a suction duct 310 is shown in cross section. In front of the entrance 43 to the suction duct 310 in the suction tube 312 a throttling valve 26'' is mounted, which is adjustable from the shown maximum open position shown into the throttled position shown by the dot-dashed lines by an adjusting device controllable by a broken yarn and roving sensor or sensing means. As in the embodiment of FIGS. 2 and 3 this embodiment can include an electromagnet.

FIG. 7 shows highly diagrammatic view of a working position of a ring spinning machine with a ring 6 around which roving 16' fed from the feed rollers 15 of a drafting frame 2 is twisted to yarn 17 eventually wound on bobbin 4. The bobbin 4 is driven by spindle 3. Roving 16 is fed to the drafting frame 2 from the bobbins 5.

I claim:

1. In a spinning machine having a feed for displacing a fibrous filament capable of breaking past a fiber suction station, an apparatus comprising:

a fiber suction duct having an outer end immediately adjacent the filament in the station and an opposite end;

means including a vacuum source for withdrawing air from the opposite end and thereby creating a low-pressure zone at the outer end of the duct;

throttling means connected to the duct and displaceable between a throttling position for restricting the flow cross section of the duct substantially while still permitting substantial flow into the outer end and an open position not substantially blocking flow through the duct; and sensing means at the station connected to the throttling means and capable of detecting breakage of the filament for normally holding the throttling means in the throttling position and switching it to the open position on detection of such filament breakage.

2. The apparatus defined in claim 1 wherein the throttling means includes a flow-obstructing member displaceable by the sensing means.

3. The apparatus defined in claim 2 wherein the flow-obstructing member has a relatively large orifice aligned in the duct in the open position and a relatively small orifice aligned in the duct in the throttling position.

4. The apparatus defined in claim 1 wherein the spinning machine has a plurality of such stations each having a respective such apparatus, the vacuum source being a common suction tube connected to all of the ducts.

5. The apparatus defined in claim 1 wherein the duct is at least partially collapsible and the throttling means collapses the duct in the throttling position.

6. The apparatus defined in claim 5 wherein the duct has an elastic wall portion and the throttling means deflects it inward into the duct in the throttling position.

7. The apparatus defined in claim 5 wherein the sensing means includes a mechanical arm bearing transversely on the filament in the station.

8. The apparatus defined in claim 7 wherein the throttling means includes a flow-obstructing member displaceable by the arm.

9. The apparatus defined in claim 7 wherein the throttling means includes a flow-obstructing member and the sensor means includes an electromagnet connected thereto.

* * * * *